US005842560A

United States Patent [19]

Kuki et al.

[11] Patent Number: 5,842,560

[45] Date of Patent: Dec. 1, 1998

[54] BREAKER DEVICE

[75] Inventors: Heiji Kuki; Kazumoto Konda; Tsutomu Tanaka; Kunihiko Watanabe, all of Yokkaichi, Japan

[73] Assignee: Sumitomo Wiring Systems, Ltd., Japan

[21] Appl. No.: 800,202

[22] Filed: Feb. 12, 1997

[30] Foreign Application Priority Data

| | | | |
|---|---|---|---|
| Feb. 15, 1996 | [JP] | Japan | 8-027801 |
| Mar. 29, 1996 | [JP] | Japan | 8-077133 |
| Apr. 17, 1996 | [JP] | Japan | 8-095736 |
| Nov. 14, 1996 | [JP] | Japan | 8-303358 |
| Nov. 15, 1996 | [JP] | Japan | 8-305259 |

[51] Int. Cl.[6] ..... H01R 13/62

[52] U.S. Cl. ..... 200/43.05; 200/51.12; 200/561; 439/261

[58] Field of Search ..... 200/43.05, 561, 200/558, 253.1, 254, 51.12; 439/261

[56] References Cited

U.S. PATENT DOCUMENTS

| | | | |
|---|---|---|---|
| 3,183,335 | 5/1965 | Cobbett | 200/254 |
| 4,026,623 | 5/1977 | Goodman et al. | 439/261 |
| 4,186,288 | 1/1980 | Overton et al. | 200/561 |
| 4,456,318 | 6/1984 | Shibata et al. | 439/261 X |

FOREIGN PATENT DOCUMENTS

| | | |
|---|---|---|
| 6-310227 | 11/1994 | Japan . |
| 6-327123 | 11/1994 | Japan . |

*Primary Examiner*—Renee S. Luebke
*Attorney, Agent, or Firm*—Anthony J. Casella; Gerald E. Hespos; Ludomir A. Budzyn

[57] ABSTRACT

A breaker device is provided to prevent an insufficient engagement of electrodes. The device, according to the invention, is excellent in safety because of its construction in which a conductive path is located inside the casing 1 and is allowed to have a compact configuration of particularly low height because a handle 40 can be inclined to its resting position. When the handle 40 is inclined to the resting position while a movable electrode 31 is insufficiently engaged, engaging portions 77 come into contact with receiving portions 75 and a lever action works with the contact positions of the engaging portions 77 and the receiving portions 75 as a fulcrum. As a result, a rotating force applied to an operable portion 40A is translated into a downward acting engaging force applied to the movable electrode 31 via rotation center shafts 45 and a mount body 35. In other words, since the movable electrode 31 is brought into its properly engaged state by inclining the handle 40 to the resting position, the insufficient engagement of the movable electrode 31 can be prevented.

4 Claims, 10 Drawing Sheets

BREAKER DEVICE

BACKGROUND OF THE INVENTION

1. Field of the Invention

The present invention relates to a breaker device disposable in a power supply circuit of, e.g. an electric automotive vehicle.

2. Description of the Prior Art

A known breaker device of this type is called a knife switch type in which a lever type movable electrode is rotatably supported on one of a pair of fixed electrodes that are spaced from one another on a base plate. Current is interrupted by inclining the movable electrode from its standing position to be inserted into an elastically holding portion formed at the other fixed electrode.

However, in the breaker device of knife switch type, a conductive path is exposed. Particularly, since a large current flows in a power line of an electric automotive vehicle, such a breaker device is not necessarily preferable in view of safety.

The fixed electrodes may be electrically connected by engaging a pair of movable electrodes therewith and may be disconnected by disengaging the movable electrodes therefrom. In this case, if a handle is provided at the pair of movable electrodes to be gripped, operability in engaging and disengaging the movable electrodes with and from the fixed electrodes can be improved. On the other hand, the breaker device is required to have a small size so that it will take up only a small space when being mounted on a vehicle body. In order to meet this requirement, the handle may be made inclinable. The handle is held in its standing position at the time of the engagement and disengagement of the movable electrodes, and is held in its resting position upon completion of the engagement or disengagement.

With the breaker device provided with an inclinable handle as described above, if, for example, a fitting resistance suddenly becomes larger during the engagement of the movable electrodes because of, e.g. waterproof O-rings mounted on the movable electrodes, there is a likelihood that an operator may misjudge that the proper engagement has been attained during the engagement; stop the engaging operation; and complete the operation by inclining the handle to its resting position.

The breaker device according to the invention was developed in view of the above problem, and an object thereof is to prevent an insufficient engagement of electrodes.

SUMMARY OF THE INVENTION

According to the invention there is provided a breaker device, comprising a pair of fixed electrodes provided in a casing. A movable electrode is provided for disconnecting and/or connecting the fixed electrodes by being engaged with and/or disengaged from the fixed electrodes. A rotatable or pivotable handle is provided at the movable electrode for the engagement and/or disengagement of the movable electrode with and/or from the fixed electrodes. Lever functioning portions are provided at the casing and the handle for coming into engagement with each other while the handle is rotated or pivoted with the movable electrode insufficiently engaged. Thus the movable electrode is displaced relative to the fixed electrodes to its proper engagement position by the action of lever.

When the handle is rotated with the movable electrode insufficiently engaged, a lever action works by the lever function portions during the rotation of the handle. Since the movable electrode is properly engaged with the fixed electrodes by the lever action as the handle is rotated, the insufficient engagement can be prevented.

According to a preferred embodiment of the invention, each lever functioning portion comprises a receiving portion which may be provided at the casing, and an engaging portion which may be provided at the handle, at a side opposite from an operable portion of the handle with respect to a rotation center shaft. A rotating force applied to the operable portion is translated into an engaging force applied to the movable electrode via the rotation center shaft by the action of lever with a position where the receiving portion and the engaging portion are engaged as a fulcrum.

When the handle is rotated with the movable electrode insufficiently engaged, the engaging portions engage the receiving portions during the rotation of the handle. The lever action works with the engagement positions of the engaging portions and the receiving portions as a fulcrum, and the rotating force applied to the operable portion acts on the movable electrode via the rotation center shaft. As a result, the movable electrode is displaced to the proper engagement position.

Preferably, the casing and the handle are provided with a rotation restricting means for restricting the rotation of the handle, in particular by the contact of a restricting portion and a slidable element while the handle is operated, preferably at least until the movable electrode reaches a proper engagement position.

While the handle is used for the engagement of the electrodes, the rotation thereof is restricted by the contact of the slidable element and the restricting portion. Thus, even if a fitting resistance increases at the start of or during the engagement, the handle 40 does not wobble, i.e. the engagement can be performed with an improved operability.

According to a further preferred embodiment, the slidable element is provided with one or more bevelled portions for facilitating the lever action or the rotation or pivotal movement of the handle or allowing for an earlier rotation of the handle, i.e. when the movable electrode is less engaged with the fixed electrodes.

Preferably, the lever functioning portions provide the action of lever, when the movable electrode is in a position substantially close or neighboring to its proper engagement position. This preferably occurs when sealing means and sealing portions provided in connection with the movable electrode and the fixed electrodes come substantially into contact with each other.

BRIEF DESCRIPTION OF THE DRAWINGS

These and other objects, features and advantages of the present invention will become more apparent upon a reading of the following detailed description and accompanying drawings in which.

DETAILED DESCRIPTION OF THE PREFERRED EMBODIMENT

Figure 1:
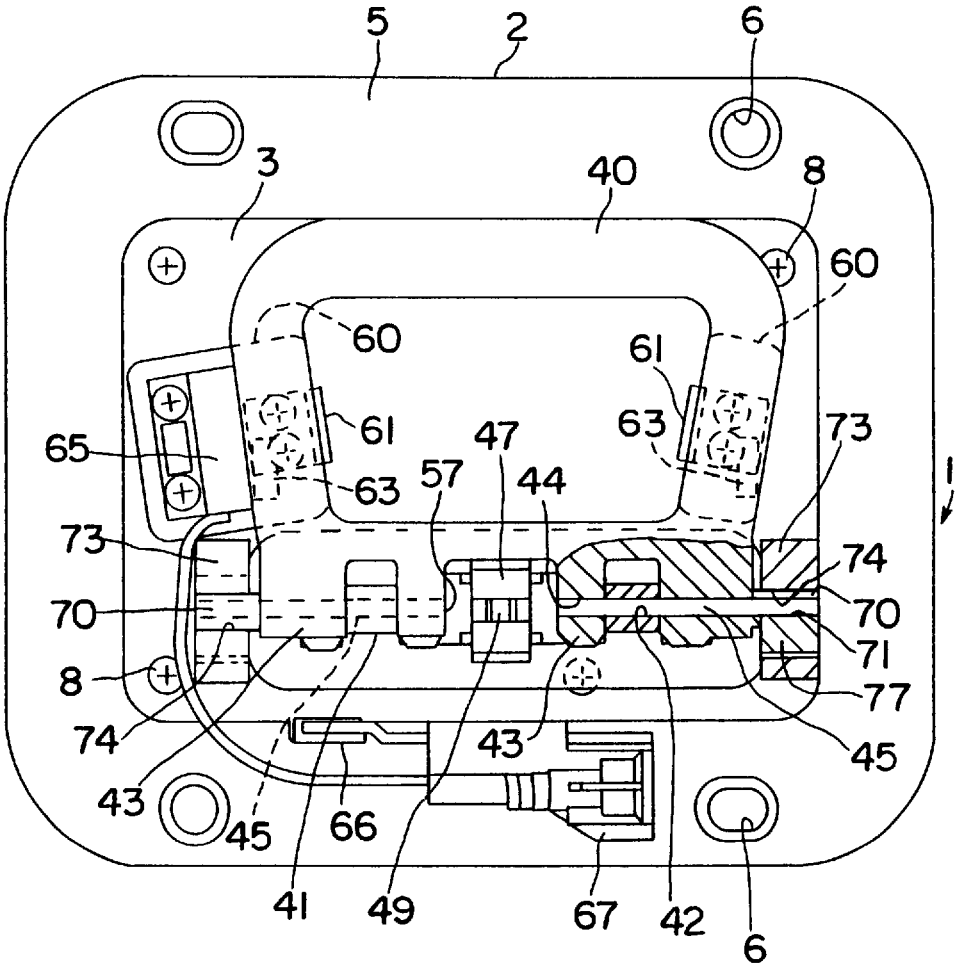
FIG. 1 is a plan view of a breaker device according to one embodiment of the invention when a handle is in its resting position.
Figure 2:
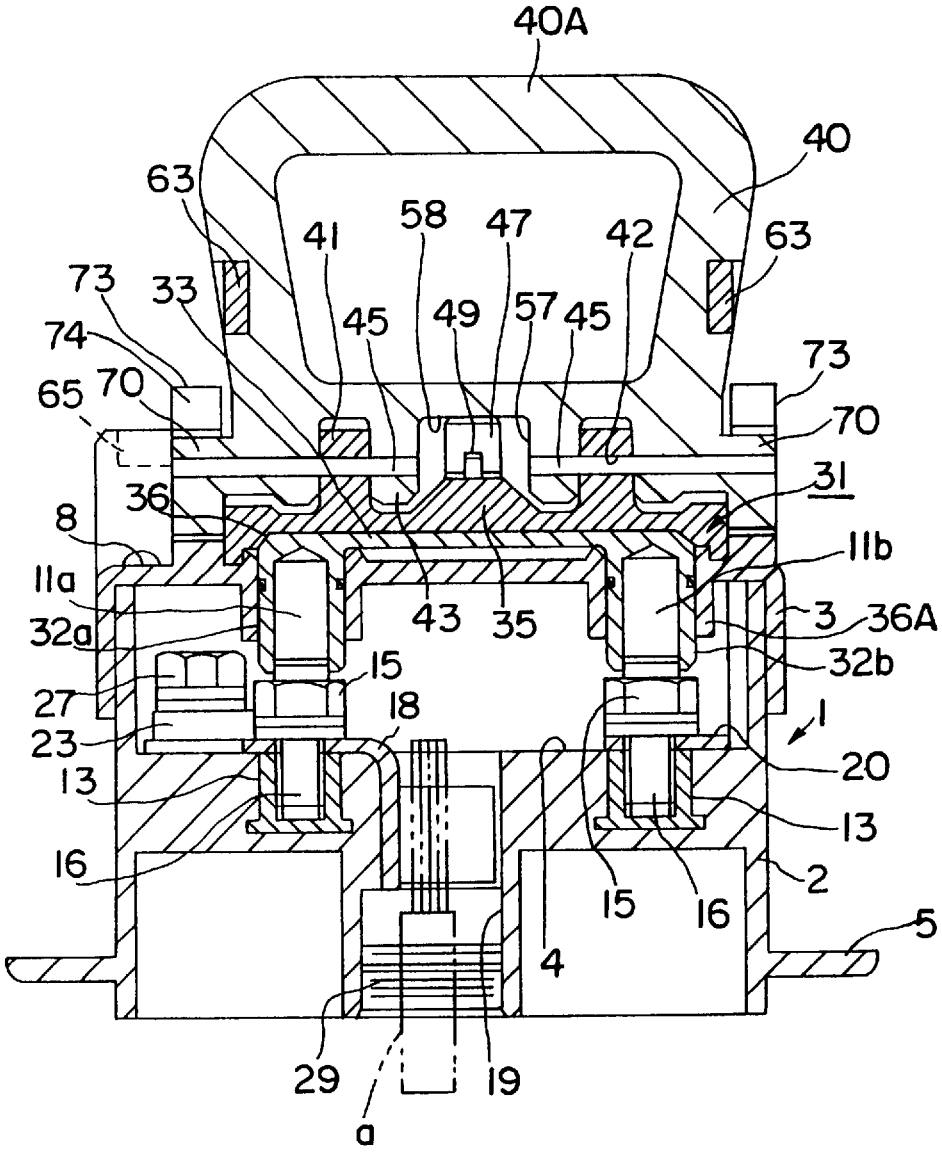
FIG. 2 is a vertical section of the breaker device when the handle is in its operative position.
Figure 3:
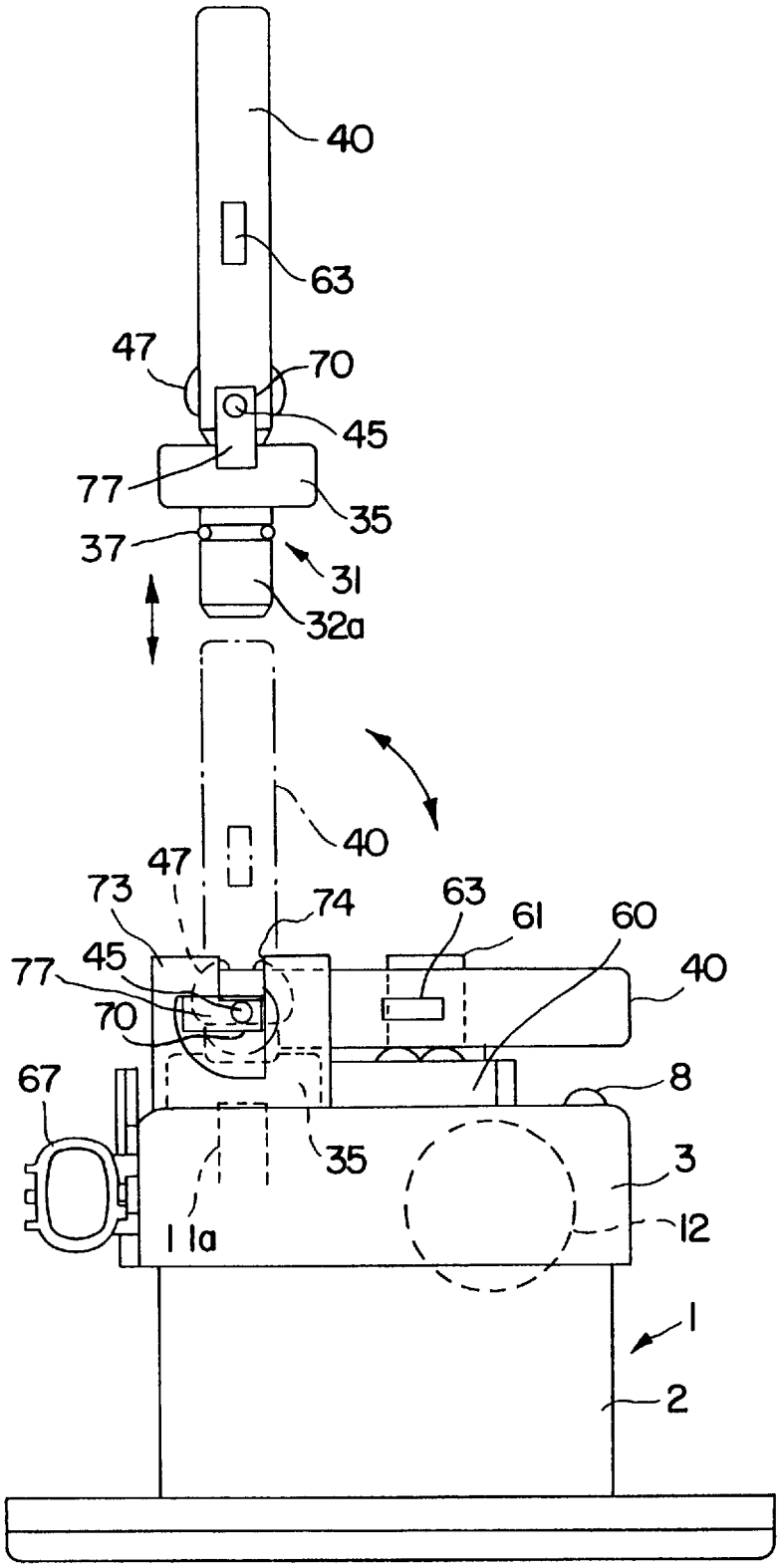
FIG. 3 is a side view showing how the handle is used for the engagement and disengagement of electrodes.

In FIGS. 1 to 3, a casing 1 made of e.g. synthetic resin includes lower and upper casings 2 and 3. The lower casing 2 is in the form of a bottomed tube having a substantially rectangular cross section, and its bottom wall 4 is located substantially in the middle of its height. Further, a mount flange 5 is formed around the outer surface of the bottom end of the lower casing 2. This flange 5 is mounted on an unillustrated vehicle body by fastening screws through mount holes 6 formed in its four corners.

The upper casing 3 is formed into a lid-like shape to be fitted to the upper end of the lower casing 2. The upper casing 3 is detachably fitted to the lower casing 2 by fastening screws 8 inserted through insertion holes formed in four corners of its upper surface into screw holes formed in four corners of the upper end surface of the lower casing 2.

In the lower casing 2, a pair of fixed electrodes 11*a*, 11*b* are placed substantially upright at one side (lower right side in FIG. 4), and a fuse 12 is accommodated at the other side. In order to stand the fixed electrodes 11*a*, 11*b*, a pair of internally threaded members 13 are buried in the bottom wall 4 at a specified interval e.g. by insert molding as shown in FIG. 2. Each of the fixed electrodes 11*a*, 11*b* is preferably in the form of a pin, and formed with a hexagonal portion 15 in its longitudinal center and with an externally threaded portion 16 at its bottom end. In other words, the respective electrodes 11*a*, 11*b* can stand by spirally fitting the externally threaded portions 16 with the corresponding internally threaded members 13.

Figure 4:
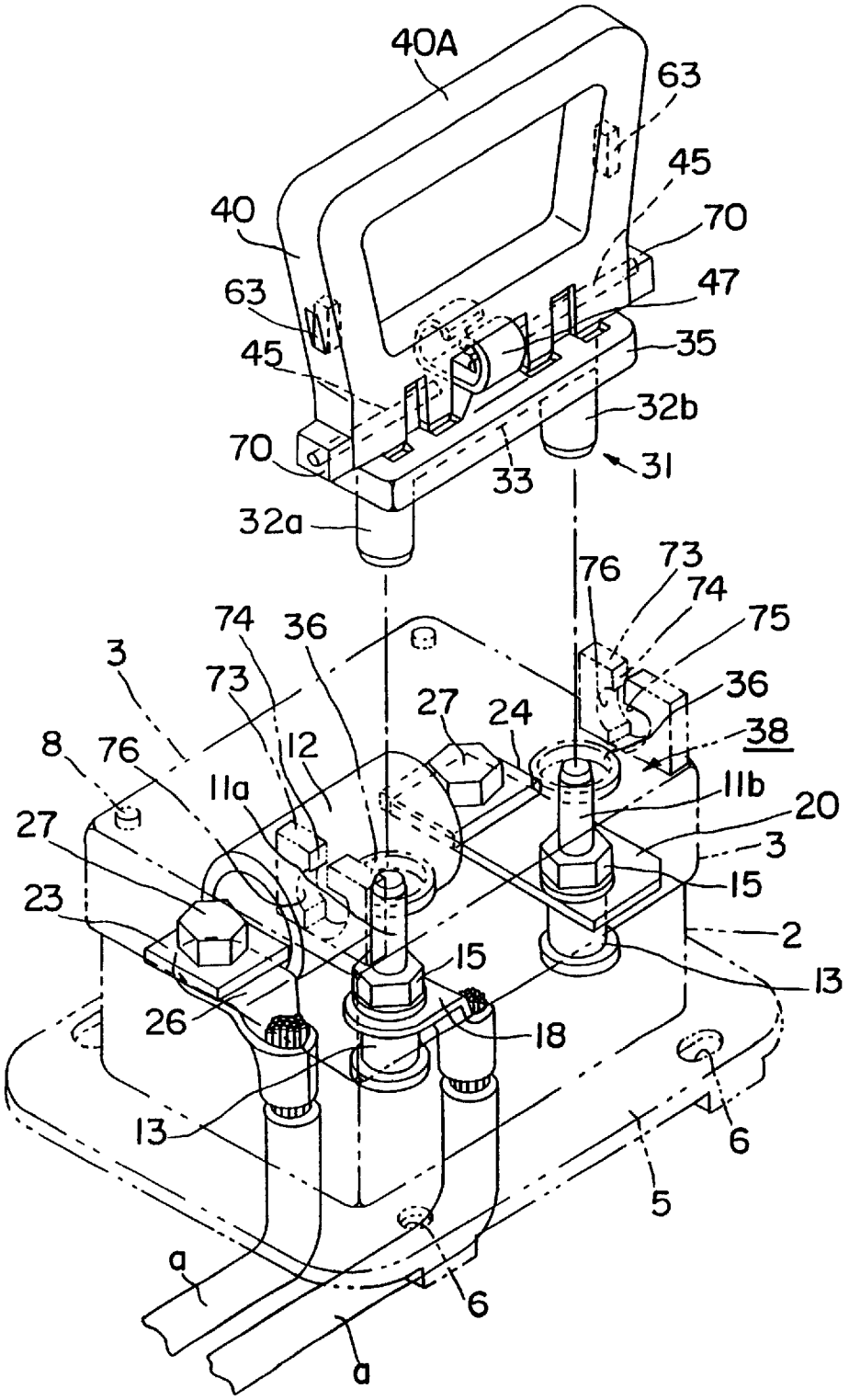
FIG. 4 is a perspective view showing the interior construction of a casing and the construction of a mount body.

As also shown in FIG. 4, a terminal fitting 18 connected with one cut end of a wire a is secured to one fixed electrode 11*a* (left one in FIG. 2). This part of the wire a is drawn out through a first insertion hole 19 formed in the bottom wall 4. Further, a busbar 20 connected with one end of the fuse 12 to be described later is secured to the other fixed electrode 11*b*.

The fuse 12 is accommodated at the other side of the bottom wall 4 of the lower casing 2. Connection members 23, 24 project from the opposite ends of the fuse 12. One connection member 23 is secured to a terminal fitting 26 connected with the other cut end of the wire a by fastening a bolt 27. This part of the wire a is drawn through a second insertion hole (not shown) similar to the above insertion hole 19 formed in the bottom wall 4. Waterproof plugs 29 mounted on the wire a are fitted into the insertion holes 19, 28 to seal the openings. To the other connection member 24 of the fuse 12 is secured one end of the substantially horizontally extending busbar 20 by another bolt 27. The other end of the busbar 20 is secured to the fixed electrode 11*b* as described above.

A movable electrode 31 is detachably engageable with or insertable or fittable on the pair of fixed electrodes 11*a*, 11*b*. As shown in FIG. 2, the movable electrode 31 is constructed such that a bridging member 33 is bridged between a pair of louver terminals 32*a*, 32*b* engageable with or fittable on the leading ends of the respective fixed electrodes 11*a*, 11*b* so as to connect the louver terminals 32*a*, 32*b*. The movable electrode 31 is formed by mounting the respective louver terminals 32*a*, 32*b* on a narrow mount body 35 e.g. of synthetic resin, such as by insert molding, so that the terminals 32*a*, 32*b* project from the bottom surface of the mount body 35. O-rings 37 are fitted on the outer surfaces of the louver terminals 32*a*, 3*b* of the movable electrode 31.

On the other hand, a pair of insertion holes 36 into which the louver terminals 32*a*, 32*b* of the movable electrode 31 are insertable are formed in positions of the ceiling wall of the upper casing 3 corresponding to or right above the fixed electrodes 11*a*, 11*b*. Tubular portions 36A are formed at the edges of the insertion holes 36 so as to extend inward of the lower casing 2. The O-rings 37 of the louver terminals 32*a*, 32*b* come into close contact with the inner surfaces of the tubular portions 36A, thereby ensuring water tightness between the louver terminals 32*a*, 32*b* and the insertion holes 36.

The louver terminals 32*a*, 32*b* are inserted into the insertion holes 36 to be engaged with the pair of fixed electrodes 11*a*, 11*b* within the casing 1, or withdrawn from the insertion holes 36 to be disengaged from the fixed electrodes 11*a*, 11*b*. In this way, there is constructed a breaker switch 38 for connecting and disconnecting the fixed electrodes 11*a*, 11*b*. The fuse 12 is disposed in an intermediate position of the wire a while being connected in series with the breaker switch 38.

A handle 40 used to engage and disengage the movable electrode 31 is provided at the upper surface of the mount body 35. The handle 40 is preferably in the form of a frame having an outer shape of substantially an inverted trapezoid. Bearing portions 41 formed with bearing holes 42 project at the opposite ends of the upper surface of the mount body 35 with respect to its longitudinal direction. Further, a pair of bearing portions 43 forked to hold the bearing portions 41 and formed with bearing holes 44 project at the edge of the mount side of the handle 40. The bearing portions 41 of the mount body 35 are fitted or inserted into recesses of the corresponding forked bearing portion 43 of the handle 40. By inserting rotation center shafts 45 through the bearing holes 42, 44 of the bearing portions 41, 43, the handle 40 is supported on the upper surface of the mount body 35, pivotally about the rotation center shafts 45.

Figure 5:
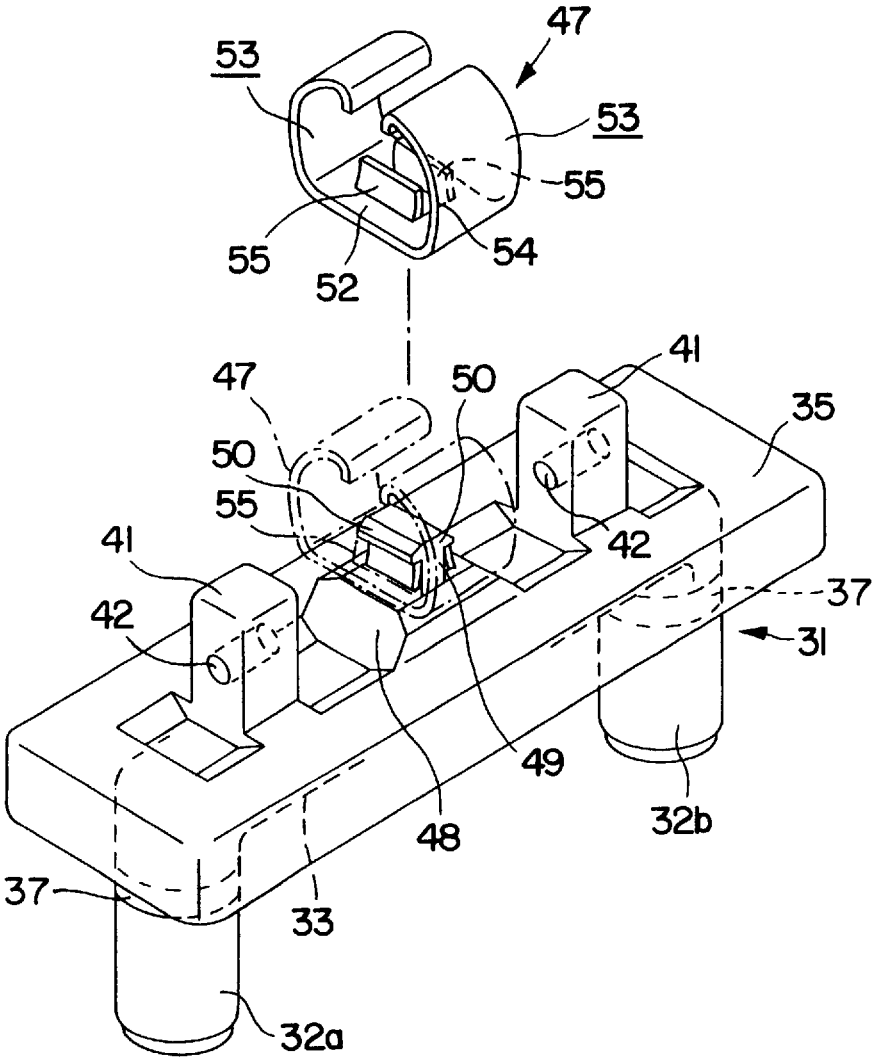
FIG. 5 is a perspective view showing the construction of a portion where a spring member is mounted.

The handle 40 can be held, by toggle action, in a standing position where it stands substantially upright at the opposite side of the louver terminals 32*a*, 32*b* (see phantom line position of FIG. 3) and in a resting position where it substantially lies in a direction at an angle different from 0° or 180°, in particular substantially normal to the projection direction of the louver terminals 32*a*, 32*b*. To this end, a spring member 47 as shown in FIG. 5 is mounted between the mount body 35 and the handle 40.

A projected portion 48 is formed substantially in the longitudinal center of the upper surface of the mount body 35, and a mount projection 49 in the form of a narrow substantially rectangular column extending in a direction at an angle different from 0° or 180°, in particular substantially normal to the longitudinal direction of the mount body 35 projects from the top surface of the projected portion 48. Hooks 50 project from the opposite longer sides of the upper end of the mount projection 49. On the other hand, the spring member 47 is made by pressing a spring steel plate, and formed such that bent portions 53 inwardly bent to have a specified shape are symmetrically formed at the opposite ends of a strip-like base plate 52. In the center of the base plate 52, there is formed a substantially rectangular engaging hole 54 fittable to the mount projection 49, and a pair of engaging portions 55 are formed by bending at the opposite longer ends of the engaging hole 54. The spring member 47 is disengageably and unrotatably mounted by fitting the engaging hole 54 with the mount projection 49 while arranging the base plate 52 and the mount body 35 such that they extend in directions at an angle different from 0° or 180°, in particular in substantially orthogonal directions until the base plate 52 is pressed against the projected portion 48 as shown by phantom line in FIG. 5, and by engaging the leading ends of the engaging portions 55 with the hooks 50 of the mount projection 49.

On the other hand, in the center of the outer surface of the mount side edge of the handle 40, there is formed a recess 57 for accommodating the spring member 47 mounted on the mount body 35. The bottom surface of the recess 57 acts as a contact surface 58 with which the bent portions 53 of the spring member 47 come into contact.

Specifically, the handle 40 is pivotal about the support shafts 45 by bringing the bent portion 53 of the spring member 47 into contact with the contact surface 58 and causing it to elastically and/or plastically contract. During this time, upon being subject to a kind of toggle action, the handle 40 can stably be held in the operative position where it extends in a direction opposite from the projecting direction of the louver terminals 32*a*, 32*b* while the contact surface 58 is held in contact with the bent portions 53 to their leading ends and in the resting position where it extends in a direction at an angle different from 0° or 180°, in particular substantially normal to the projecting direction of the louver terminals 32*a*, 32*b* while the contact surface 58 is completely held in contact with the side surface of either one of the bent portions 53.

In positions of the ceiling surface of the upper casing 3 corresponding to the accommodated fuse 12, support tables 60 are provided as shown in FIGS. 1 and 3. A substantially L-shaped receiving member 61 is mounted on each support table 60. The receiving members 61 receive the substantially center portions of the opposite side portions of the handle 40 when the movable electrode 31 is properly engaged with the fixed electrodes 11*a*, 11*b* and the handle 40 is inclined to its resting position.

Magnets 63 are mounted preferably in symmetrical positions of the outer surfaces of the opposite side portions of the handle 40. On the other hand, a lead switch 65 is mounted on the ceiling surface of the upper casing 3. The lead switch 65 is so disposed as to be located right before one of the magnets 63 when the movable electrode 31 is properly engaged with the fixed electrodes 11*a*, 11*b* and the handle 40 is inclined to its resisting position as described above, and outputs a detection signal when the magnet 63 comes right before it. The lead switch 65 is connected with an unillustrated control unit for performing necessary controls via a connector 67 mounted by a bracket 66 at one side surface of the upper casing 3.

In this embodiment, there are further provided a rotation restricting means for guiding the movable electrode 31 to the position for the engagement with the fixed electrodes 11*a*, 11*b* and a lever functioning portion for preventing the movable electrode 31 from being held insufficiently engaged with the fixed electrodes 11*a*, 11*b*. Hereafter, these two means are described.

Figure 6:
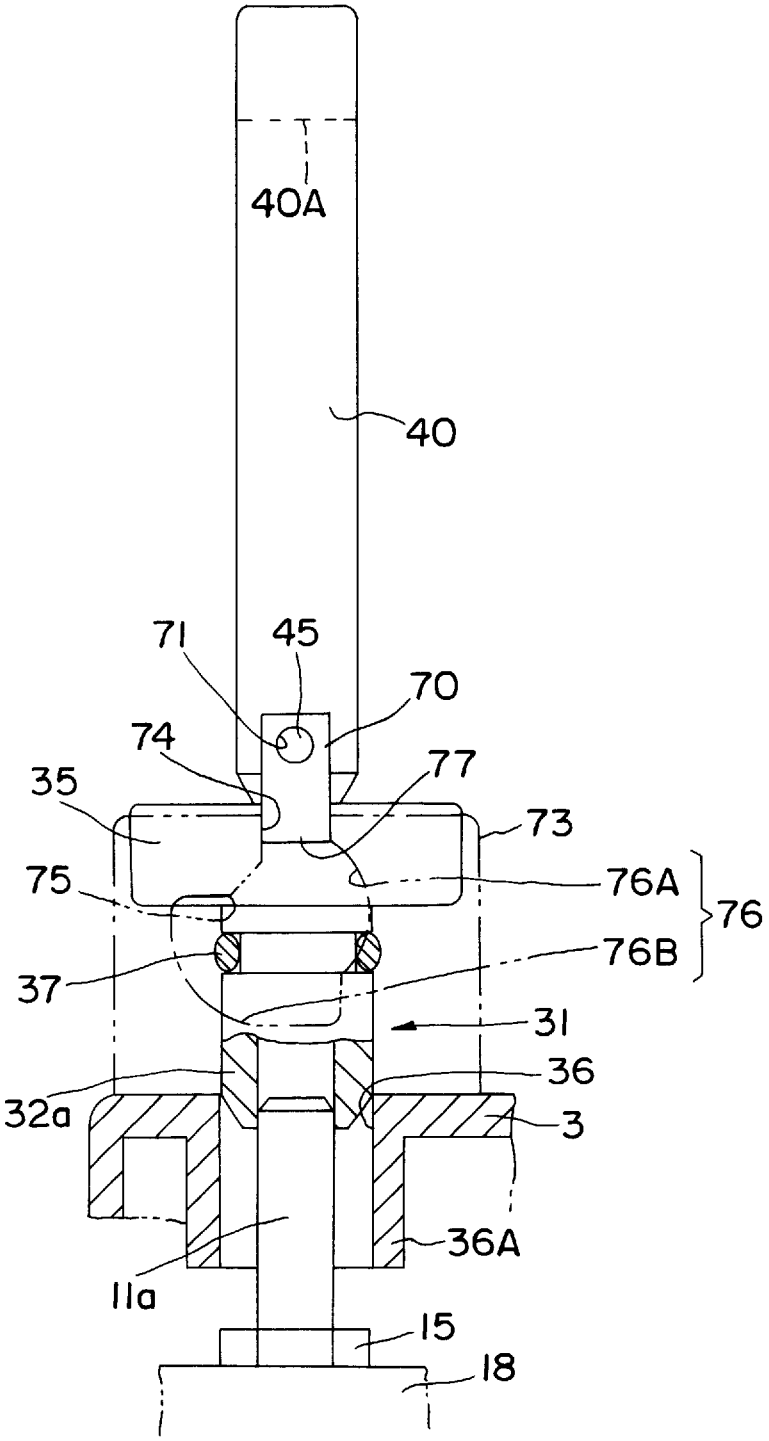
FIG. 6 is a partial side view showing a state at the start of the engagement of the electrodes.

At the opposite outer surfaces of the handle 40 where the rotation center shafts 45 are formed, slidable projections (slidable element according to the invention) 70 in the form of rectangular columns are integrally formed to project toward the opposite ends of the rotation center shafts 45. In each slidable projection 70, an insertion hole 71 for the corresponding shaft 45 is substantially coaxially formed with the bearing hole 44. The bearing hole 44 and the insertion hole 71 are located in a position displaced upward from the center position of the slidable projection 70 as shown in FIG. 6. As a result, the slidable projection 70 projects toward a side opposite from an operable portion 40A of the handle 40, i.e. toward the movable electrode 31 shown in FIG. 6. The projecting end of the slidable projection 70 acts as an engaging portion 77 which displays a lever action as described later.

On the other hand, a guide wall 73 stands at each of left and right sides of the upper surface of the upper casing 3 where the handle 40 is inserted. Each guide wall 73 is formed with a restricting slot 74 (restricting portion according to the invention) for guiding the slidable projection 70 while the handle 40 is inserted. The restricting slot 74 is open in a direction of insertion of the movable electrode 31, in particular substantially upward and extends along the vertical direction as shown in FIG. 6. The slidable projection 70 is fitted or inserted into the restricting slot 74 such that it can freely make only a sliding movement. The restricting slot 74 and the slidable projection 70 construct a rotation restricting means according to the invention. When the handle 40 is used for the engagement of the electrodes with the slidable projections 70 fitted in the restricting slots 74, the rotation thereof is restricted during an intermediate state which starts immediately after the start of the engagement of the movable electrode 31 with the fixed electrodes and lasts until the movable electrode 31 is properly engaged with the fixed electrodes 11*a*, 11*b*.

In each guide wall 73, a largely cut out rotation permitting portion 76 is formed continuously with and below or after the restricting slot 74 (as seen in a direction of insertion). A surface of the rotation permitting portion 76 at the right side of FIGS. 6 to 7 acts as a small arcuate surface 76A for avoiding the interference with a portion of the slidable projection 70 close to the rotation center shaft 45. On the other had, a surface of the rotation permitting portion 76 opposite from the small arcuate surface 76A acts as a large arcuate portion 76B for avoiding the interference with the engaging portion 77 at the leading end of the slidable projection 70. When the O-rings 37 come into contact with the opening edges of the insertion holes 36 of the lower casing 2 as the engagement of the movable electrode 31 progresses, the slidable projections 70 are positioned in the rotation permitting portions 76 through the restricting slots 74. As a result, the rotation of the handle 40 from the operative position to the resting position is permitted.

A portion connecting the large arcuate portion 76B and the restricting slot 74 acts as a receiving portion 75 engageable with the corresponding engaging portion 77. The receiving portion 75 and the engaging portion 77 construct a lever functioning portion according to the invention. If the handle 40 is rotated from the operative position to the resting position in a state where the movable electrode 31 is insufficiently engaged with the fixed electrodes 11*a*, 11*b*, i.e. the rotation center shafts 45 are located above their positions attainable at the time of the proper engagement of the electrodes, the engaging portions 77 substantially come into contact with the receiving portions 75 from below (or in a direction against insertion). If the handle 40 is further rotated while the engaging portions 77 and the receiving portions 75 are engaged with each other, a lever action works with the engagement positions of the engaging portions 77 and the receiving portions 75 as a fulcrum. A rotating force applied to the operable portion 40A acts on the movable electrode 31 in an engaging direction via the rotation center shafts 45 and the mount body 35. Further, the engaging force which acts on the movable electrode 31 at this time is larger than the force applied to the operable portion 40A.

Next, the operation of this embodiment is described.

The pair of fixed electrodes 11*a*, 11*b* stand and the fuse 12 is accommodated in the casing 1, and the fixed electrodes 11*a*, 11*b* and the fuse 12 are connected between the cut ends of the wire a as described above. In order to bring the wire a into a conductive state, the handle 40 is raised to its operative position outside the casing 1. Then, the handle 40 is held in the operative position by the aforementioned toggle action of the spring member 47.

Subsequently, the louver terminals 32*a*, 32*b* of the movable electrode 31 projecting from the mount body 35 are inserted into the insertion holes 36 formed in the upper casing 3 by gripping the operable portion 40A of the handle 40. At this time, since the handle 40 is held onto the mount body 35, the mount body 35 or the movable electrode 31 does not wobble, with the result that the louver terminals 32*a*, 32*b* can smoothly be inserted into the insertion holes 36.

During the insertion, as shown in FIG. 6, the louver terminals 32*a*, 32*b* of the movable electrode 31 are so positioned as to be fittable to or insertable on the fixed electrodes 11*a*, 11*b*, in particular by fitting the slidable projections 70 into the restricting slots 74. Thus, the movable electrode 31 can easily and securely be fitted to the fixed electrodes 11*a*, 11*b* and can be inserted into the insertion holes 36.

Further, the rotation of the handle 40 is restricted by fitting the slidable projections 70 into the restricting slots 74. Accordingly, even if a fitting resistance acts at the start of the engagement of the louver terminals 32*a*, 32*b* with the fixed electrodes 11*a*, 11*b*, the handle 40 does not wobble, i.e. the engagement can be performed with an improved operability.

A fitting resistance acts between the electrodes upon the start of the engagement of the louver terminals 32*a*, 32*b* with the corresponding fixed electrodes 11*a*, 11*b*. However, since the louver terminals 32*a*, 32*b* are guided by the tubular portions 36A extending downward from the insertion holes 36, the handle 40 does not wobble. Further, the wobble of the handle 40 with respect to the louver terminals 32*a*, 32*b* is prevented by the holding force of the spring member 47 as well as by the fitting of the slidable projections 70 into the restricting slots 74. Thus, the handle 40 is pressed straight while being held in a fixed position without rotating, and the louver terminals 32*a*, 32*b* are smoothly engaged with the fixed electrodes 11*a*, 11*b*.

Figure 7:
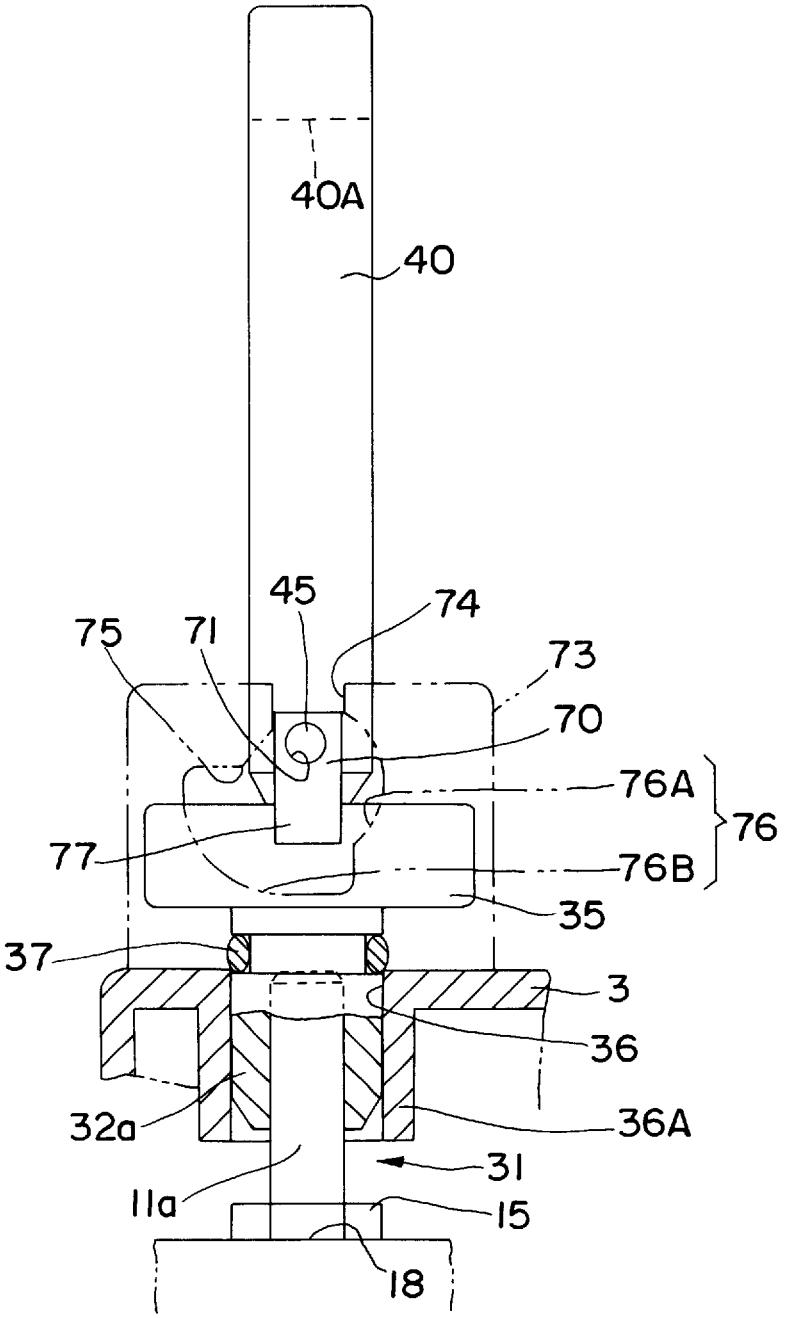
FIG. 7 is a partial side view showing a state where the handle is rotatable.

As the engagement of the louver terminals 32*a*, 32*b* progresses, the O-rings 37 come into contact with the edges of the insertion holes 36 as shown in FIG. 7. If the handle 40 is further pressed in this state, the movable electrode 31 is properly engaged with the fixed electrodes 11*a*, 11*b*. Thereby, the breaker switch 38 is turned on, and the wire a is brought into a conductive or usable state via the fuse 12.

Figure 9:
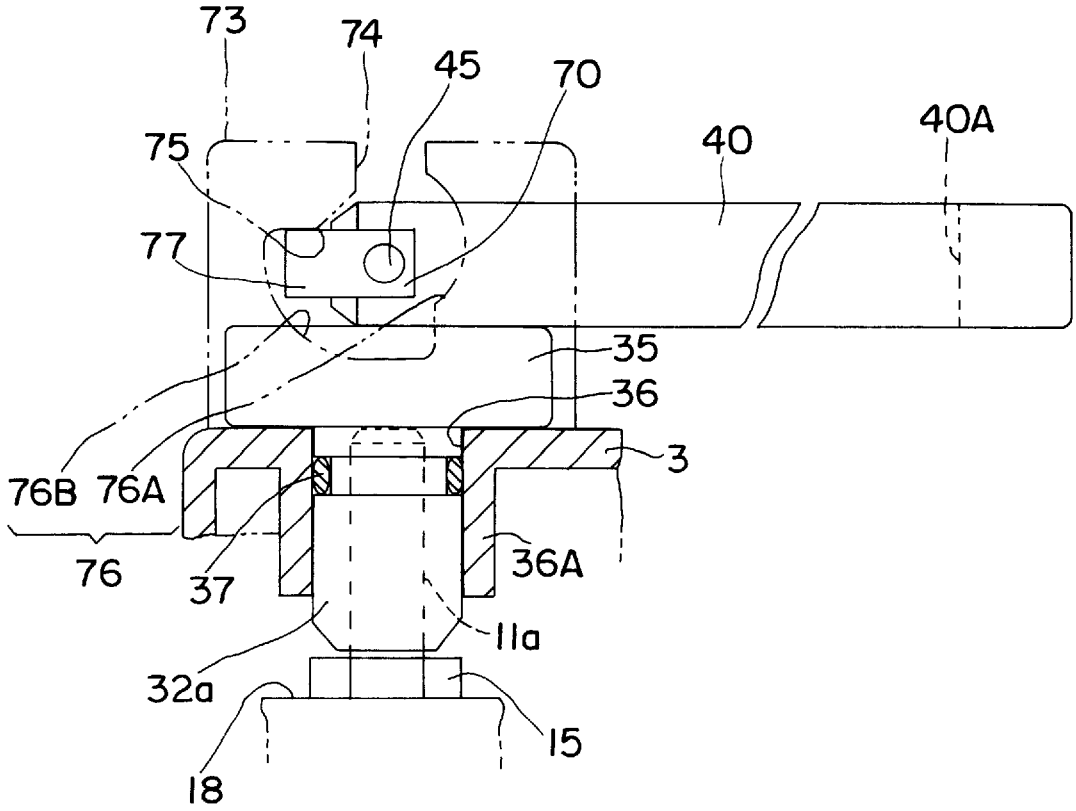
FIG. 9 is a partial side view showing a state where the electrodes are properly engaged.

If the handle 40 is inclined to the resting position as shown in FIG. 9 after the movable electrode 31 is properly engaged with the fixed electrodes 11*a*, 11*b*, one of the magnets 63 provided at the handle 40 is located immediate before the lead switch 65, which in turn sends a detection signal. As a result, it can electrically be detected that the breaker switch 38 is properly turned on.

Since the handle 40 is also held in the resting position by the toggle action of the spring member 47, it does not wobble even upon being subjected to vibrations while a vehicle is driving.

In the above engagement, after coming into contact with the edges of the insertion holes 36 as shown in FIG. 7, the O-rings 37 are pressed into the insertion holes 36 while undergoing an elastic deformation, with the result that the fitting resistance suddenly becomes larger. This may cause an undesirable situation where an operator misjudges that the proper engagement has been attained despite the fact that the electrodes are still insufficiently engaged, stops the engaging operation, and moves onto an operation of rotating the handle 40 to the resting position. However, according to this embodiment, the movable electrode 31 can properly be engaged with the fixed electrodes 11*a*, 11*b* even in such a case.

Figure 8:
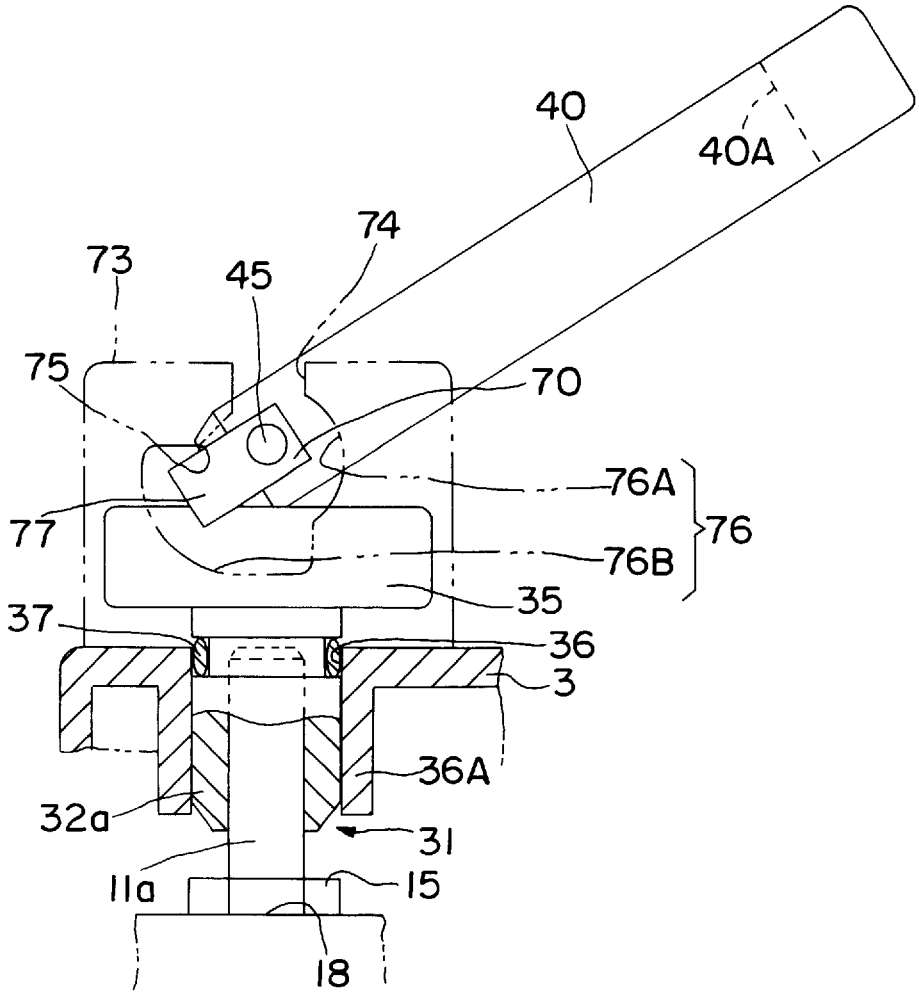
FIG. 8, is a partial side view showing a state where the handle is rotated with the electrodes insufficiently engaged.

More specifically, if the handle 40 is rotated to the resting position with the movable electrode 31 insufficiently engaged as shown in FIG. 7, the engaging portions 77 at the leading ends of the slidable projections 70 come into contact with the receiving portions 75 from below during the rotation of the handle 40. If the handle 40 is further rotated in this state, a lever action works with the engagement positions of the engaging portions 77 and the receiving portions 75 as a fulcrum. The rotating force applied to the operable portion 40A is translated into a particularly downward acting engaging force applied to the movable electrode 31 via the rotation center shafts 45 and the mount body 35. Even if the rotating force is small, the engaging force becomes larger by the action of lever. Accordingly, the louver terminals 32*a*, 32*b* can easily be inserted into the insertion holes 36 against the elastic forces of the O-rings 37 and engaged with the fixed electrodes 11*a*, 11*b* (see FIG. 8). The movable electrode 31 reaches a proper engagement position when the handle 40 is inclined to the resting position.

When the breaker switch 38 is turned off for the maintenance, the handle 40 is raised to the standing position from the resting position indicated by solid line in FIG. 3. The handle 40 is then pulled up to withdraw the movable electrode 31 from the fixed electrodes 11*a*, 11*b*, with the result that the breaker switch 38 is turned off, bringing the wire a into a nonconductive state.

Further, when the fuse 12 blows out, the breaker switch 38 is turned off by withdrawing the movable electrode 31 in the similar manner as above, and the screws 8 are loosened to remove the upper casing 3. Since the fuse 12 is exposed in this state, the fuse 12 is removed by loosening the bolts 27 and replaced with a new one. Because the breaker switch 38 is already turned off, the fuse 12 can be safely exchanged.

As described above, the breaker device of this embodiment is excellent in safety because of its construction in which the conductive path is located inside the casing 1 and is allowed to have a compact configuration of particularly low height while being in use because the handle 40 can be inclined to the resting position.

Further, even if the handle 40 is inclined toward the resting position while the movable electrode 31 is insufficiently engaged, the movable electrode 31 can be brought into a properly engaged state by the action of lever. The prevents the movable electrode 31 from being held insufficiently engaged.

Figure 10:
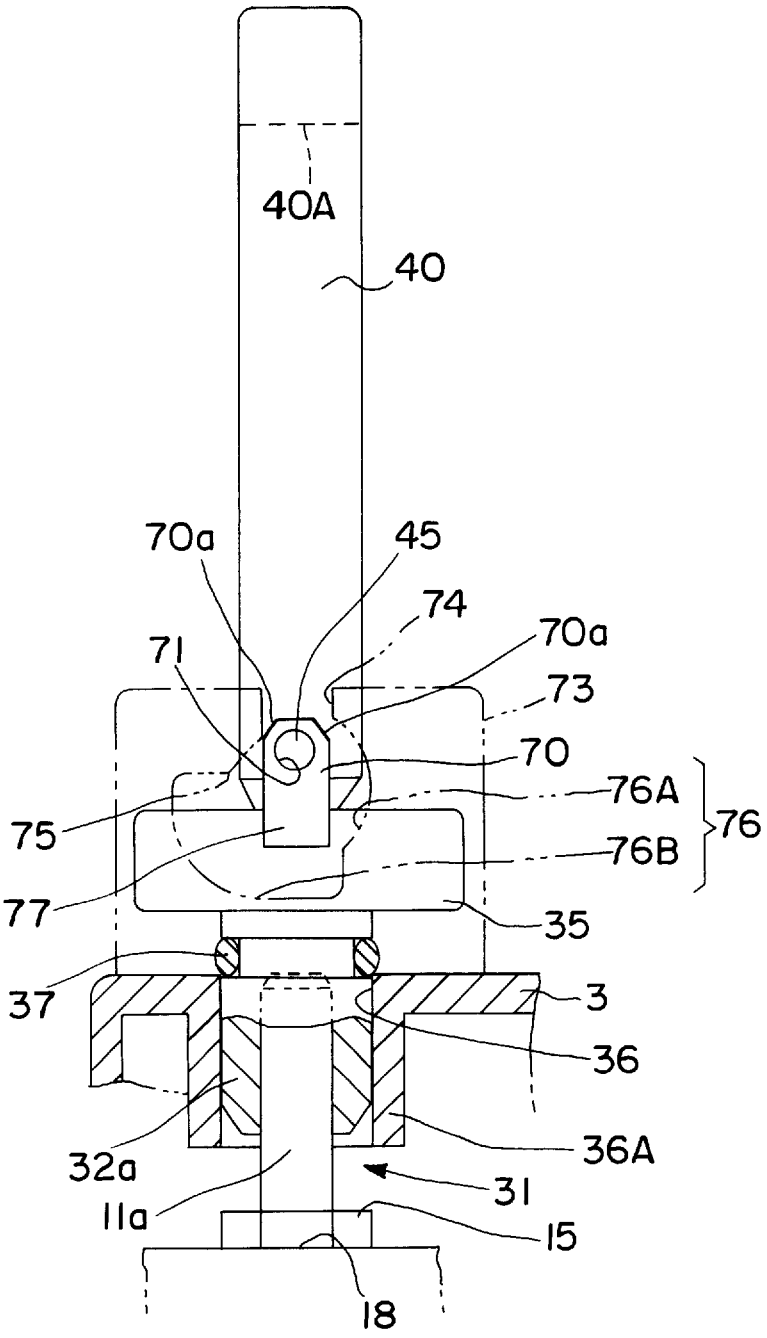
FIG. 10 is a partial side view of a further embodiment of the invention.

FIG. 10 shows a further preferred embodiment of the invention, in which the slidable element 70 is formed with one or more bevelled portions 70*a*, such that a rotation or pivotal movement of the handle 40 can be performed earlier, i.e. when the movable electrode 31 is less engaged with the fixed electrodes 11*a*, 11*b*. The bevelled portions 70*a* prevent the slidable element 70 to interact with the linear portion 74 in such a position, when the slidable element 70 is already substantially arranged in the rotation permitting portion 76, therefore allowing for an earlier lever action by the lever functioning portion 75, 76.

The present invention is not limited to the foregoing embodiment described above and shown in the drawings. For example, the following embodiment is embraced by the technical scope of the present invention as defined by the claims, and a variety of other changes are possible without departing from the spirit and scope of the present invention as defined in the claims besides the following embodiment.

(1) Although the restricting portion (restricting slots 74) is provided at the casing and the slidable element (slidable projections 70) is provided at the handle in the foregoing embodiment, the slidable element may be provided at the casing while the restricting portion being provided at the handle according to the invention.

(2) Although the restricting portion is a slot into which the slidable element is fittable in the foregoing embodiment, it may be a projection and a slot formed in the slidable element may be engaged with this projection according to the invention.

(3) Although the rotation restricting means constructed by the restricting slots 74 and the slidable projections 70 is provided in the foregoing embodiment, such a means may be dispensed with according to the invention.

(4) Although the engaging portions 77 of the handle 40 project toward a direction directly opposite from the operable portion 40A with respect to the rotation center shafts 45, the engaging portions may project in an oblique direction with respect to the operable portion according to the invention.

(5) Although the lever functioning portion (the engaging portion 77 and the receiving portion 75) is provided at each of the opposite ends with respect to the longitudinal direction of the rotation center shafts 45 in the foregoing embodiment, it may be provided in other position, e.g. a center position according to the invention.

(6) Although the engaging portion 77 constructing the lever functioning portion is provided at the leading end of the slidable projection 70 constructing the rotation restricting means in the foregoing embodiment, the engaging portion may be provided independently of the slidable element according to the invention.

(7) Although the O-rings 37 as seal members are mounted on the movable electrode 31 in the foregoing embodiment, the seal members may be fitted to the insertion holes formed in the lower casing according to the invention.

(8) Although the foregoing embodiment is directed to a waterproof breaker device in which the movable electrode 31 is engaged with the lower casing 2 via the O-rings, the invention may be applied to a non-waterproof breaker device having no seal means such as an O-ring.

(9) In the foregoing embodiment, the handle is made rotatable between the operative position and the resting position to enhance operability and make the breaker device as a whole smaller. However, according to the invention, the starting and end positions of the rotation of the handle may arbitrarily be set.

What is claimed is:

1. A breaker device, comprising:

a pair of fixed electrodes provided in a casing, a movable electrode for selectively disconnecting and connecting the fixed electrodes by selectively engaging and the disengaging from the fixed electrodes, a handle rotatably provided at the movable electrode for the selective engagement and disengagement of the movable electrode relative to the fixed electrodes, the handle and the casing being provided with a rotation restricting means for restricting the rotation of the handle by contact between a restricting portion and a slidable element while the handle is operated at least until the movable electrode engages the fixed electrodes, and lever functioning portions comprising a receiving portion provided at the casing and an engaging portion on a side of the handle opposite from an operable portion of the handle with respect to a rotation center shaft, said receiving portion and said engaging portion being for selective engagement with each other while the handle is rotated for displacing the movable electrode to its proper engagement position by a lever action, wherein a rotating force applied to the operable portion is translated into an engaging force applied to the movable electrode via the rotation center shaft by the lever action with a position where the receiving portion and the engaging portion are engaged as a fulcrum.

2. A breaker device according to claim 1, wherein the slidable element is provided with one or more bevelled portions for facilitating the lever action.

3. A breaker device according to claim 1, wherein the lever functioning portions provide the action of lever, when the movable electrode is in a position substantially close to its proper engagement position.

4. A breaker device according to claim 1, wherein said lever receiving portion defines a pair of stops for limiting rotation of said handle to substantially 90°.

* * * * *